US011118437B2

(12) United States Patent
Stokkevåg et al.

(10) Patent No.: US 11,118,437 B2
(45) Date of Patent: Sep. 14, 2021

(54) HIGH RATE SAFETY SHUTDOWN SYSTEM WITH HYDRAULIC DRIVEN FLUID ENDS

(71) Applicant: IMPACT SOLUTIONS AS, Ulsteinvik (NO)

(72) Inventors: Terje Stokkevåg, Ulsteinvik (NO); Oddgeir Husøy, Fosnavaag (NO); Paul George, Denver, CO (US)

(73) Assignee: Impact Solutions AS, Ulsteinvik (NO)

( * ) Notice: Subject to any disclaimer, the term of this patent is extended or adjusted under 35 U.S.C. 154(b) by 201 days.

(21) Appl. No.: 16/549,248

(22) Filed: Aug. 23, 2019

(65) Prior Publication Data

US 2020/0063540 A1 Feb. 27, 2020

Related U.S. Application Data

(60) Provisional application No. 62/722,004, filed on Aug. 23, 2018.

(51) Int. Cl.
*E21B 21/08* (2006.01)
*E21B 43/12* (2006.01)
(Continued)

(52) U.S. Cl.
CPC ..... *E21B 43/126* (2013.01); *E21B 21/08* (2013.01); *E21B 21/106* (2013.01); *E21B 41/0021* (2013.01); *E21B 44/005* (2013.01)

(58) Field of Classification Search
CPC .... E21B 21/08; E21B 21/106; E21B 41/0021; E21B 42/126; E21B 44/005; F04B 1/295; F04B 1/324
See application file for complete search history.

(56) References Cited

U.S. PATENT DOCUMENTS 4,227,862 A 10/1980 Andrew et al.
5,132,904 A 7/1992 Lamp
(Continued)

FOREIGN PATENT DOCUMENTS

CN 201273266 Y 7/2009
GB 2330598 A 4/1999
(Continued)

OTHER PUBLICATIONS

PCT Application No. PCT/IB2019/057127, International Search Report and Written Opinion, dated Nov. 18, 2019, 11 pages.
(Continued)

*Primary Examiner* — D. Andrews
*Assistant Examiner* — Ronald R Runyan
(74) *Attorney, Agent, or Firm* — Avant Law Group, LLC

(57) ABSTRACT

A method of controlling a high-pressure system having an engine, and a hydraulic pump having a swashplate includes inputting a maximum discharge pressure, a maximum allowable equipment pressure, a pressure relief valve (PRV) setting, a flowrate, and a maximum positive and negative rate of change of pressure; setting a work value to full power; setting a first position of the swashplate based on flowrate; determining: (a) if a discharge pressure is greater than the PRV setting; (b) if the discharge pressure is greater than the maximum allowable equipment pressure; and (c) if a rate of change of pressure is greater than the maximum positive rate of change of pressure or the maximum negative rate of change of pressure; and upon the occurrence of any of steps (a)-(c): (d) activating a PRV in the system; (e) setting the swashplate position to neutral; and (f) reducing the power to zero.

20 Claims, 5 Drawing Sheets

(51) Int. Cl.

| | |
|---|---|
| ***E21B 41/00*** | (2006.01) |
| ***E21B 21/10*** | (2006.01) |
| *E21B 44/00* | (2006.01) |

(56) References Cited

U.S. PATENT DOCUMENTS

| | | | | |
|---|---|---|---|---|
| 8,540,493 | B2 | 9/2013 | Koehl | |
| 9,322,243 | B2 | 4/2016 | Baca et al. | |
| 9,441,453 | B2 | 9/2016 | Lymberopoulos et al. | |
| 9,677,391 | B2 * | 6/2017 | Banks | F16K 17/1606 |
| 9,890,609 | B2 | 2/2018 | Lymberopoulos et al. | |
| 9,970,278 | B2 | 5/2018 | Broussard et al. | |
| 10,550,665 | B1 * | 2/2020 | Golden | F16K 31/041 |
| 10,627,003 | B2 * | 4/2020 | Dale | F16K 17/168 |
| 10,670,003 | B1 * | 6/2020 | Wang | F04B 27/1063 |
| 2006/0219299 | A1 | 10/2006 | Snowbarger | |
| 2014/0048255 | A1 * | 2/2014 | Baca | E21B 34/02 166/250.1 |

FOREIGN PATENT DOCUMENTS

| | | | |
|---|---|---|---|
| GB | 2350382 | A | 11/2000 |
| WO | 1992013195 | A1 | 8/1992 |

OTHER PUBLICATIONS

Pratt Control Systems, https://www.henrypratt.com/sites/henrypratt.com/files/uploads/media/pratt_controlsystembrouupdate_ft3828_v2.pdf, dated 2017, 12 pages.

* cited by examiner

FIG. 1 – PRIOR ART

HIGH RATE SAFETY SHUTDOWN SYSTEM WITH HYDRAULIC DRIVEN FLUID ENDS

CROSS-REFERENCE TO RELATED APPLICATIONS

This application claims priority to U.S. provisional patent application no 62/722,004, filed Aug. 23, 2018, the entirety of which is incorporated herein by reference.

BACKGROUND

Hydraulic fracturing (fracking) systems use fluids at very high pressures and flow rates to fracture underground rock formations for oil and gas exploration and recovery. Due to the high pressures and flow rates, the interactions between the fluid and the mechanical systems at the surface and the well bore are complex, not to mention the interaction between the fluid and the down hole formations. Combinations of well bore, fluids, and formation interactions can produce severe and near instantaneous pressure changes, immediate back pressures, and or flow rate stoppage due to bridge-off. There can also be unintentional valve closures which may cause similar effects to the pressure at the surface. System pressures exceeding intended designs and safety factors can thus be encountered with limited or no warning. It is beneficial to have a safety shutdown system that can help to prevent or mitigate dangers associated with the use of high pressure, high flow rate fracking fluids.

SUMMARY

The following presents a simplified summary of the invention in order to provide a basic understanding of some aspects of the invention. The summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

In one embodiment, a high rate safety shutdown system includes an engine, a gearbox, a hydraulic pump having a swashplate and a hydraulically driven reciprocating cylinder operable to drive a reciprocating piston in a fluid end of the pump, a pressure sensor, a pressure relief valve, and a control system operable to control the hydraulic pump and the engine. The control system has a processor in data communication with at least one input/output device, and computer memory. The computer memory includes a program that has machine readable instructions that, when effected by the processor, perform the following steps: (a) receive set threshold values from the input/output device for maximum treating pressure, maximum allowable equipment pressure, maximum rate of change of pressure, pressure relief valve setting, and flow rate; (b) determine a first position of the swashplate as a function of the flow rate; (c) activate the engine to provide power to the hydraulic pump; (d) determine a first discharge pressure of the system via the pressure sensor; (e) determine a rate of change of pressure via the pressure sensor; (f) determine if: (f1) the first discharge pressure is greater than the pressure relief valve setting; (f2) the first discharge pressure is greater than the maximum allowable equipment pressure; and (f3) the rate of change of pressure is greater than the maximum rate of change of pressure; (g) determine if: (g1) the discharge pressure is less than the maximum allowable equipment pressure but greater than the maximum treating pressure; and (g2) the rate of change of pressure is less than the maximum rate of change of pressure; (h) trigger the pressure relief valve and determine a second position of the swashplate upon the occurrence of (f1), (f2), or (f3); and (i) determine a third position of the swashplate upon the occurrence of (g1) and (g2).

In another embodiment, a high rate safety shutdown system includes an engine, a gearbox, a hydraulic pump having a swashplate and a hydraulically driven reciprocating cylinder operable to drive a reciprocating piston in a fluid end of the pump, a pressure sensor, and a control system operable to control the hydraulic pump and the engine. The control system has a processor in data communication with at least one input/output device, and computer memory. The computer memory includes a program having machine readable instructions that, when effected by the processor, iteratively perform the following steps: (a) receiving set threshold values from the input/output device for maximum treating pressure, maximum allowable equipment pressure, maximum rate of change of pressure, pressure relief valve setting, and flow rate; (b) determining a first position of the swashplate as a function of the flow rate; (c) activating the engine to provide power to the hydraulic pump; (d) determining a first discharge pressure of the system via the pressure sensor; (e) determining if: (e1) the first discharge pressure is greater than the pressure relief valve setting; (e2) the first discharge pressure is greater than the maximum allowable equipment pressure; and (e3) the rate of change of pressure is greater than the maximum rate of change of pressure; and (f) upon the occurrence of (e1), (e2) or (e3), setting the swashplate to a neutral position, activating the pressure relief vale, and reducing the power to the engine.

In still another embodiment, a method of controlling a high-pressure system that includes an engine, and a hydraulic pump having a swashplate and a hydraulically driven reciprocating cylinder operable to drive a reciprocating piston in a fluid end of the pump has at least the following steps. (1) Inputting a maximum discharge pressure, a maximum allowable equipment pressure, a pressure relief valve setting, a flowrate, a maximum positive rate of change of pressure, and a maximum negative rate of change of pressure; (2) setting a work value of the high-pressure system to required power; (3) setting a first position of the swashplate as a function of flowrate; (4) determining: (a) if a discharge pressure is greater than the pressure relief valve setting; (b) if the discharge pressure is greater than the maximum allowable equipment pressure; (c) if a rate of change of pressure is greater than the maximum positive rate of change of pressure; and (d) if the rate of change of pressure is greater than the maximum negative rate of change of pressure; (5) upon the occurrence of any of steps 4(a)-4(d): (a) activating a pressure relief valve in the system; (b) setting the swashplate position to neutral; and (c) reducing the power to zero.

BRIEF DESCRIPTIONS OF THE DRAWINGS

DETAILED DESCRIPTION

Fracking systems are designed to handle the high pressures and flow rates associated with the fracking fluid. The valves and piping systems which carry the fluids under pressure and at high rates at surface are complex, and are almost inevitably subject to severe and near instantaneous pressure changes. These severe and near instantaneous pressure changes are extremely dangerous to persons working near the system, and to the health of the system itself. Therefore, safety components are incorporated into the system to minimize risks to human life and catastrophic failure of the system by relieving pressure if a pressure increase occurs that exceeds the equipment and/or well design parameters.

Figure 1:
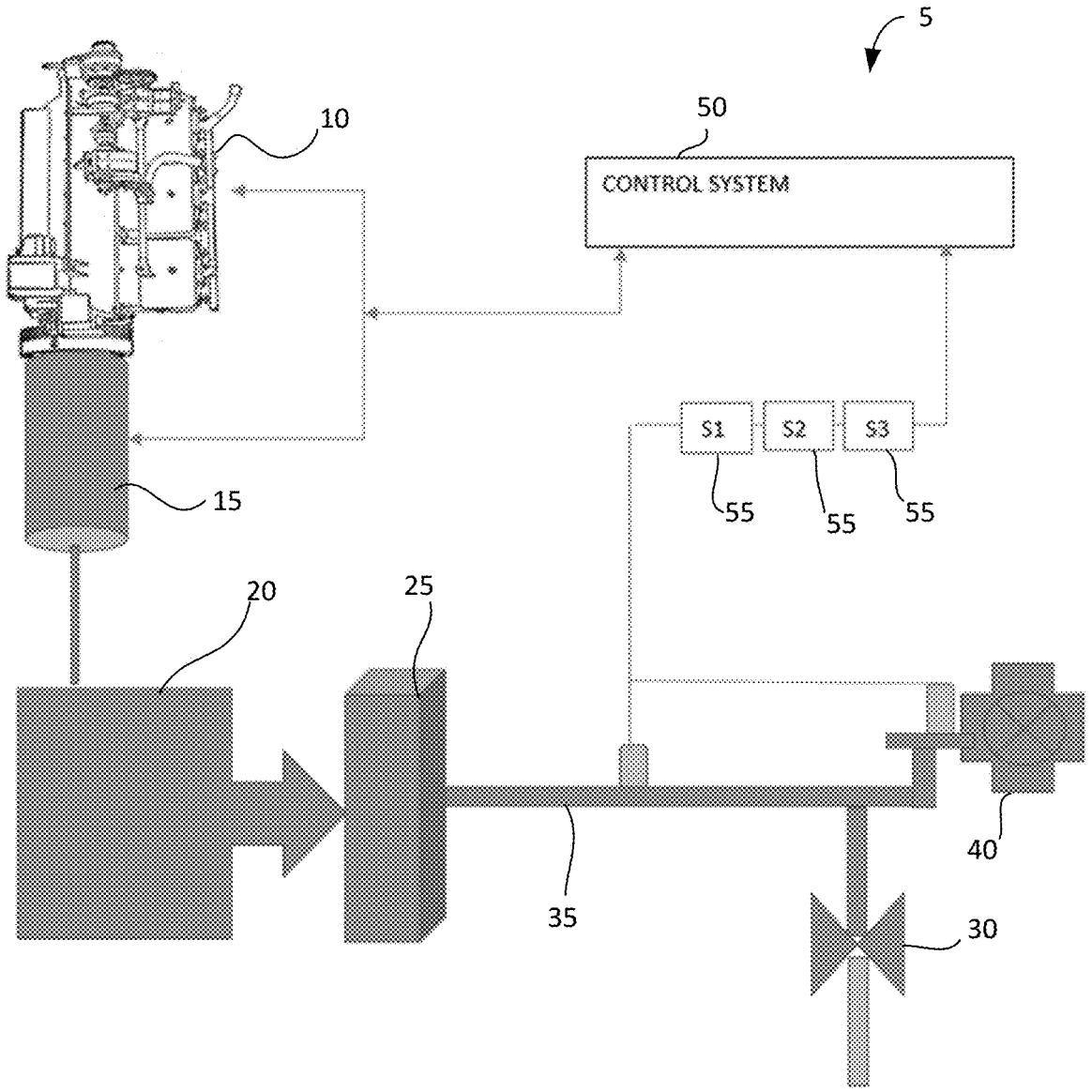
FIG. 1 is a schematic illustration of a prior art high pressure safety control system.

In typical systems, such as the system 5 shown in FIG. 1, high pressure pumps used in hydraulic fracturing systems are combinations of components comprising one or more engines 10 (e.g., diesel, electric, turbine, etc.), transmissions 15, power ends 20, and fluid ends 25. Energy is mechanically transferred between the components. Specifically, the power end 20 comprises a crankshaft, reduction gears, bearings, connecting rods, crossheads, crosshead extension rods, etc. configured to convert rotational energy to reciprocating energy. The fluid ends 25 are configured as reciprocating high-pressure pumps. Certain pumps which are commonly used include Triplex or Quintuplex pumps, which have multiple inner chambers or cylinders arranged side-by-side. Each fluid end 25 includes a section where the fracking fluid is imported through a suction manifold into a central cylinder and discharged through a discharge manifold. Each fluid end 25 is designed to produce very high pressures and flow rates of fracking fluids, which are highly abrasive.

The combination of engine(s) 10, transmission(s) 15, power end(s) 20, and fluid end(s) 25 are, by design, configured to provide significant force and momentum built up in rotational and reciprocating motion. Large masses, high rotational speeds, heavy crank shaft designs, and heavy plunger designs contribute to this. While such systems are effective to provide the necessary high-pressure fluids needed for fracking, they cannot be stopped instantaneously, or near instantaneously in present configurations. Specifically, the mechanical drives and rotating reciprocating members utilized in current systems between the power sources 20 and the fluid ends 25 cannot be quickly decoupled or de-energized resulting in continued high-pressure contribution to the system for unacceptable times. In order to provide adequate safety measures, various mechanical high-pressure relief mechanisms 30 are incorporated on the fluid ends, and within the conduits 35, piping, and the manifolds that transport the fluids to the wellhead 40. These pressure relief systems are intended to relieve or vent fluid, pressure and flow to the external atmosphere thereby avoiding significant overpressure, and catastrophic failure of equipment.

Pressure relief systems often include the use of pressure relief valves 30, such as pop-off relief valves (PRVs). The valves are directly connected to high pressure conduit systems 35 and manifolds that are used to transport high pressure fluids to the well head 40 (as shown in FIG. 1). These valves 30 mechanically open when a predetermined set pressure in the device is reached, allowing fluids and/or gases to vent to atmosphere away from the operating area. Multiple combinations and/or locations of pop-off valves are utilized within the high-pressure system. Multiple configurations of pop-off valves may be used such as mechanical shear pins, burst or rupture discs, and/or gas-charged, or Nitrogen pop off systems to name a few.

Regardless of the specific configuration, all pop-offs valves are designed such that when a certain pressure threshold is reached, they relieve the pressure to atmospheric conditions in a controlled manner. The valves may be set to different pressures. For example, certain valves may be mechanically set to a pressure ("P1") as a primary relief mechanism. P1 is typically the maximum treating pressure to which the formation or wellhead may be exposed based on the program design and client requirements. Certain other valves may be mechanically set to trigger at a pressure ("P2"), which is equal to or exceeds the sum of P1 and an overrange pressure as a secondary relief mechanism. P2 is typically set based on the maximum allowable pressure for the system, or that the equipment may be subjected to. P2 is a value that is below the safe working pressure of the equipment, and above P1.

All pop-off valves require significant maintenance after a release often due to the extreme conditions of the materials contacting the valves, including the corrosive nature and the high pressures and high flow rates of the fluids. Moreover, sand and other materials can plug or block various orifices used to trigger the pressure relief valves. Because of this, pop-off valves are susceptible to failure, and can be unreliable. When a PRV is activated, the system must be shut down and mechanically reset, retested, and restarted. The restart process may take a significant amount of time.

There are various forms of computer regulated pressure relief valve systems that have been previously utilized. These are still part of the high-pressure conduit system. A computer control module is hooked up to a traditional form of pressure relief valve and, based on information from an input pressure sensor, mechanically opens or closes this valve. Although more effective than other historical systems, they do not stop, control, regulate, or manage the source of the pressure, which is the fluid ends.

The pressure relief systems that are incorporated into the high-pressure conduits between energizing systems and the wellhead are considered both primary and secondary in nature. Some systems may additionally have pump trip pressures set for an emergency shutdown system that are monitored by pressure sensors 55 operable in conjunction with a control system 50 to shift the pump transmission into neutral and idle the engine. This essentially disconnects the engine from the system. However, the transmission components, driveshaft, and power ends remain connected, and there is therefore residual motion that remains in the system. Pump trip pressures are typically set at a pressure P1 or nominally close to pressure P1, but use of such a shutdown system is not relied on or preferred because there is still pressure overshoot, and it is slow to stop pressure buildup. It may also be triggered or used as a primary shut down when other extraneous events occur such as fire, leaks, or other emergency situations. When other pressure events occur, such as exceeding P1 or P2, it is generally used in conjunction with or after these events have been triggered.

Described herein are embodiments of a high rate safety shutdown system that provides increased safety and reliability as compared to prior art systems. According to one embodiment, a hydraulic drive high rate safety shutdown system is designed with one or more engines, gearboxes, hydraulic pumps, hydraulic control systems, and hydraulically driven reciprocating cylinders which are used to drive reciprocating pistons in the fluid ends. The power supply and energy from the engines is converted to hydraulic energy for use within the hydraulic system. The hydraulic system includes controls and fluid connections which transfer, manage, and exchange power to hydraulically reciprocating cylinders and fluid end combinations.

Figure 2:
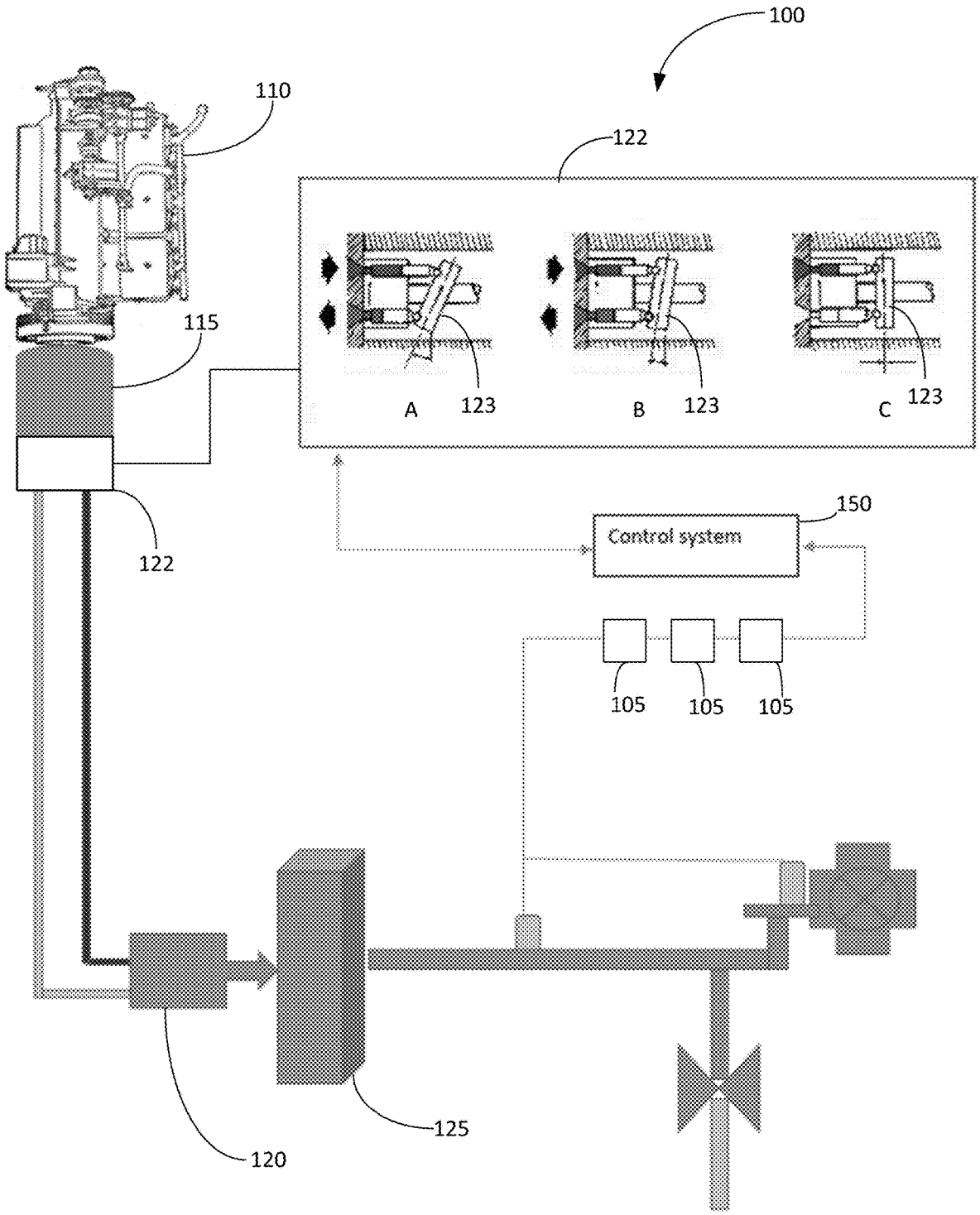
FIG. 2 is a schematic illustration of a control system according to an embodiment of the invention.

FIG. 2 is a schematic illustration of an embodiment of a high rate safety shutdown system 100. Like in FIG. 1, an engine 110 coupled to a pump 122 and optionally a gear box 115 provides the necessary power to the system 100. As can be seen, in FIG. 2, a hydraulic control system 150 is operably connected to one or more pressure sensors 105 (S1, S2, S3, etc.) and is operable to control an angle of the swashplate 123 in the hydraulic pump 122 (having a hydraulic cylinder 120 and a fluid end 125) to reduce or increase pressures within the system 100. In FIG. 2, the angle of the swashplate 123 as shown at diagram A represents the maximum swashplate angle, which provides maximum displacement. In diagram B, the angle of the swashplate 123 is decreased, providing only partial displacement. Finally, in diagram C, the swashplate 123 is substantially vertical, or at a "zero" angle, which provides no displace.

High sample rate pressure sensors 105 may be employed to measure the pressure of the hydraulics and the well pressure. Set points are input into the hydraulic control system 150 based on required maximum pressures. Thresholds are set so that if the measured pressure (e.g., from the pressure sensors 105) exceeds the set point, then the hydraulic drive energy is instantaneously released, thereby stopping the energy imparted to the fluid pumps and arresting the pumping actions.

Figure 3:
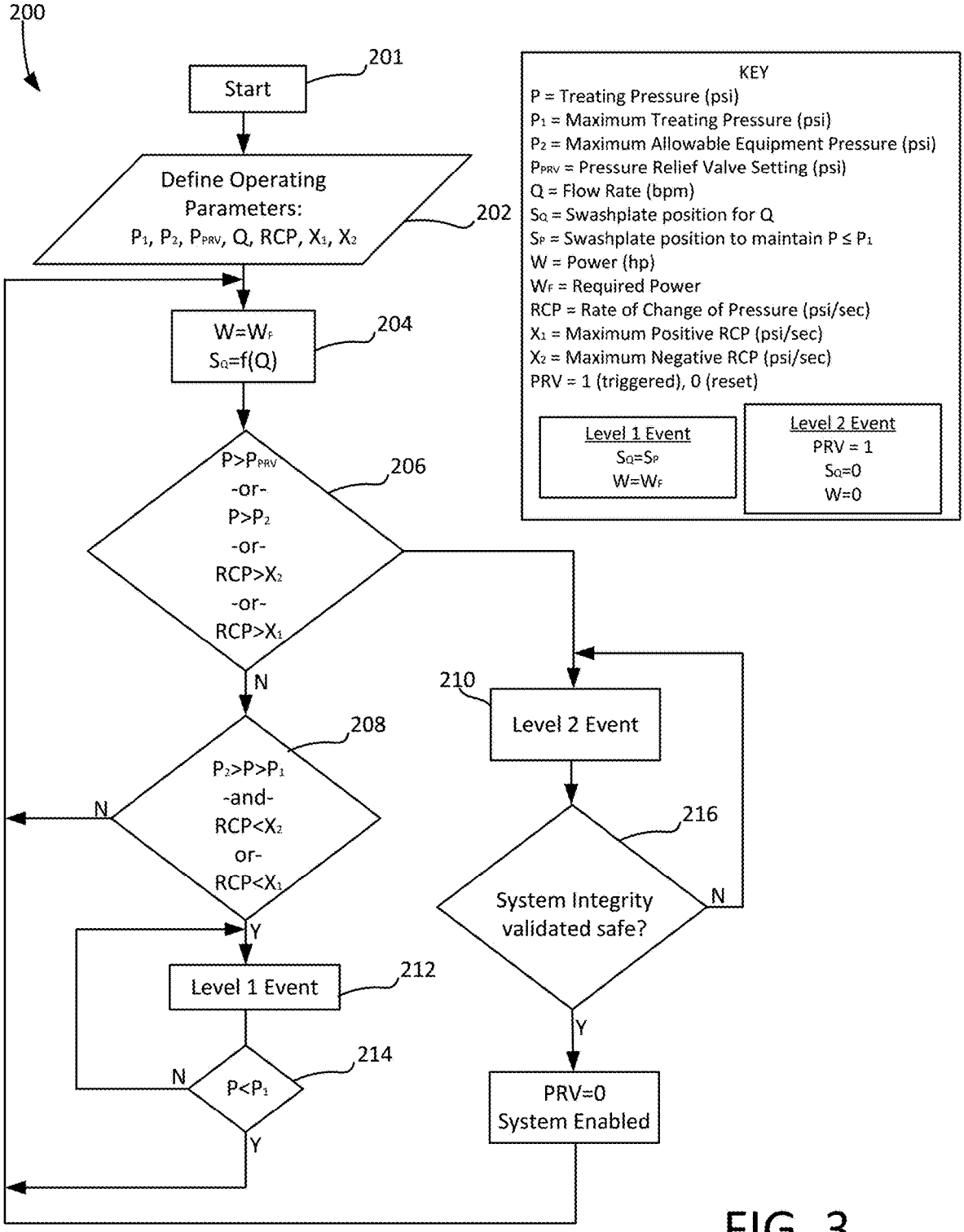
FIG. 3 is a flowchart showing the process steps of a control system according to an embodiment of the invention.

FIG. 3 is a flow chart illustrating the step sequence of an exemplary active control system process 200. The process begins at step 201. At step 202, the threshold values are input into the system, e.g., by a user of the system utilizing an input device such as a computer. It shall be understood that the computer may, but need not be, a mobile device. Accordingly, the control system 200 may be equipped with a networking device for communicating with a remote device over a network, as is known to those of skill in the art. The threshold values may include the anticipated treating (or discharge) pressure ($P_{fr}$), the maximum formation treating pressure ($P_1$), the maximum equipment pressure ($P_2$) as determined by the equipment operator, the pressure relief valve setting ($P_{PRV}$) (or the maximum equipment pressure as controlled via the PRV, wherein the PRV mechanically releases pressure and vents to atmosphere), the flow rate (Q), the maximum rate of positive change of pressure ($x_1$), and the maximum rate of negative change of pressure ($x_2$).

In one example, the maximum treating pressure is set to 8000 psi, pressure overrange is set to 500 psi, and the flow rate is set to 80 bpm. It shall be understood that these values are exemplary in nature only, and that the input values can be any value depending on the system. Moving on, at step 204, the swashplate position is determined as a function of the desired flowrate, and the power to the system is set to required power. The process then moves to step 206.

At step 206, a pressure sensor 105 determines the discharge (or treating) pressure. If one of the following events occurs, then a Level 2 event is identified at step 206: (1) the discharge pressure is greater than the pressure relief valve setting; (2) the discharge pressure is greater than the maximum allowable equipment pressure; (3) the rate of change of pressure (i.e., acceleration) is greater than the maximum negative rate of change of pressure; or (4) the rate of change of pressure is greater than the maximum positive rate of change of pressure. If a Level 2 event is identified at step 206, then a Level 2 mechanical shutdown occurs at step 210, which is described in greater detail below. If a Level 2 event is not identified at step 206, then the process moves to step 208.

If the discharge pressure is less than the maximum equipment pressure but greater than the maximum treating pressure; and either (1) the rate of change of pressure is less than the maximum negative rate of change of pressure; or (2) the rate of change of pressure is less than the maximum positive rate of change of pressure, then a Level 1 event is identified at step 208. If a Level 1 event is identified at step 208, then a Level 1 event is initiated at step 212. If not, then the process returns to step 206.

When the system indicates a Level 1 event at step 212, the control system sets the swashplate position to a position that is sufficient to decrease the discharge pressure to below the maximum treating pressure. When the swashplate is shifted, drive power to the pump is adjusted. Engine power is simultaneously separately adjusted in order to minimize potential for engine damage or over speed. This instantaneously decreases hydraulic power application to the cylinders which are driving the fluid ends. With less power, and absent the same momentum and inertia within transmission and the power end, the reaction is almost instantaneous. This very quickly stops the increase of pressure within the system, preventing a potentially hazardous situation.

Figure 4:
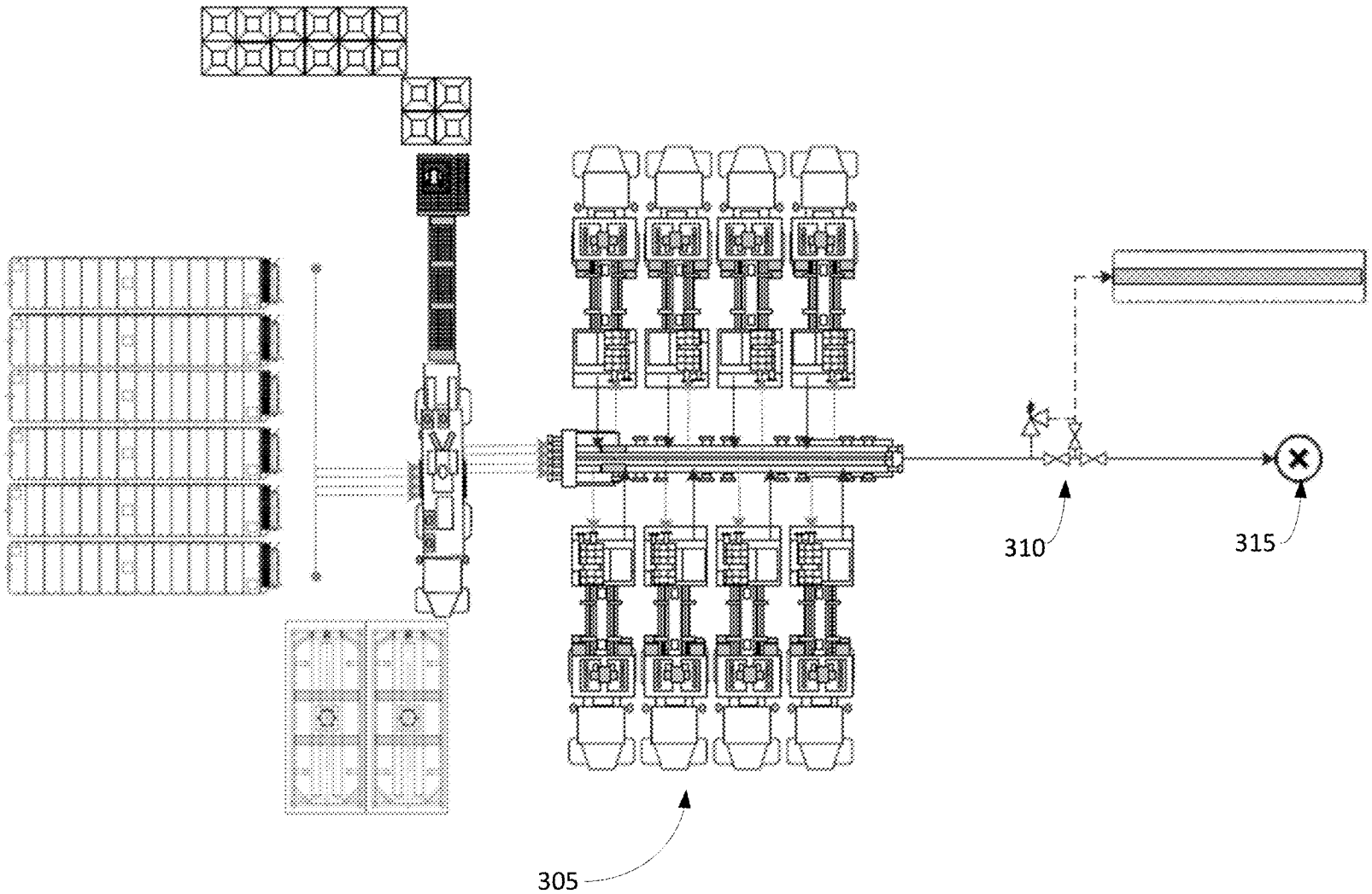
FIG. 4 is a schematic illustration of a hydraulic fracturing system according to an embodiment of the invention.

When the system indicates a Level 2 shutdown at step 210, a pressure relieve valve within the high-pressure conduit system may be activated to provide relief via known bleed techniques, the swashplate position is set to 0, and power is reduced to zero. In FIG. 4, a pressure relief valve assembly 310 is shown in a position between the hydraulic fracturing pumps 305 of the hydraulic fracturing system and the wellhead 315. In a Level 2 shutdown, the pressure relief valve assembly 310 would mechanically release to reduce pressure in the system 100 if pressure is greater than the PRV set point.

Once a Level 1 event is indicated at step 212 the process moves to step 214, where it is determined whether the discharge pressure is reduced below the maximum treating pressure such that continued safe operation is possible. If so, then the process returns to step 204. If a Level 1 event occurs, the high-pressure systems and PRVs are still competent and the hydraulics are immediately ready and available. Significantly, because full reengagement of the system can occur without requiring reset of mechanical valves used in the high-pressure conduits, the reengagement may take place in a fraction of the time that was previously required.

A Level 2 shutdown at step 210 will generally require user intervention at step 216 to determine that the high-pressure systems are competent, all pressure containment systems are safety reinitialized, and the PRVs are functional. If the system is not safe, then the Level 2 event status is maintained. Once the system is validated as safe, the PRVs are reset (set to a "0" value), and the process returns to step 204.

The system may be configured to compare the discharge pressure against the anticipated treating pressure. So long as the discharge pressure is equal to the anticipated treating pressure, normal operations are in progress. As is known to those in the art, the discharge pressure may operate within a predefined range depending on the formation response and the stage of operation. Further, as those of skill in the art will understand, if the discharge pressure is greater than the maximum formation treating pressure, or less than the maximum equipment pressure, then the system will adjust the rates via the swashplate to decrease the pressure and flow rate.

According to the invention, and as described above, if the discharge pressure is greater than the maximum equipment pressure (e.g., step 206), then the system will automatically fully depower itself, and the swashplate is set to a neutral position. This is an indication that an extra ordinary event has occurred, and the system cannot be reset until a worker has confirmed that it is safe to proceed. Because hydraulics can react nearly instantly, further pressure increase can be stopped almost immediately when the discharge pressure exceeds the maximum equipment pressure. There is no reliance on the pressure relief valve.

Likewise, if the system determines that the rate of change of pressure is greater than the maximum rate of positive change of pressure, and/or that the rate of change of pressure is greater than the maximum rate of negative change of pressure (e.g., step 206), then the system will automatically depower itself, and the swashplate is set to a neutral position. Again, this is an indication that an extra ordinary event has occurred, and the system cannot be reset until a worker has confirmed that it is safe to proceed. By monitoring the rate of change of pressure against the maximum rate of positive change of pressure and maximum rate of negative change of pressure, it is possible to anticipate a shutdown before it occurs. For example, when the rate of change of pressure is greater than the maximum rate of positive change of pressure, there is an indication that one or more conduits is plugged, or the formation is plugged, for example, and shutdown can occur before catastrophe, or before the discharge pressure exceeds the maximum equipment pressure. Likewise, when the rate of change of pressure is greater than the maximum rate of negative change of pressure, there is an indication of loss of pressure in the system, for example, due to a PRV opening to atmosphere, or a line burst. However, because the system operates on hydraulics, shutdown can occur almost simultaneously with the determination that the rate of change of pressure is too high, and the system can shut down before catastrophe occurs.

In some situations, a full shutdown may not be required. For example, if the discharge pressure is higher than the maximum equipment pressure as controlled by the pressure relief valve (i.e., the pressure is higher than the PRV setting), then the PRV will mechanically release and relieve the pressure to atmosphere. Here too, the system may be depowered and the swashplate may be set to a neutral position. However, user intervention to correct the PRV may not be required to restart the system if only maximum equipment pressure is exceeded, but the PRV does not mechanically.

Figure 5:
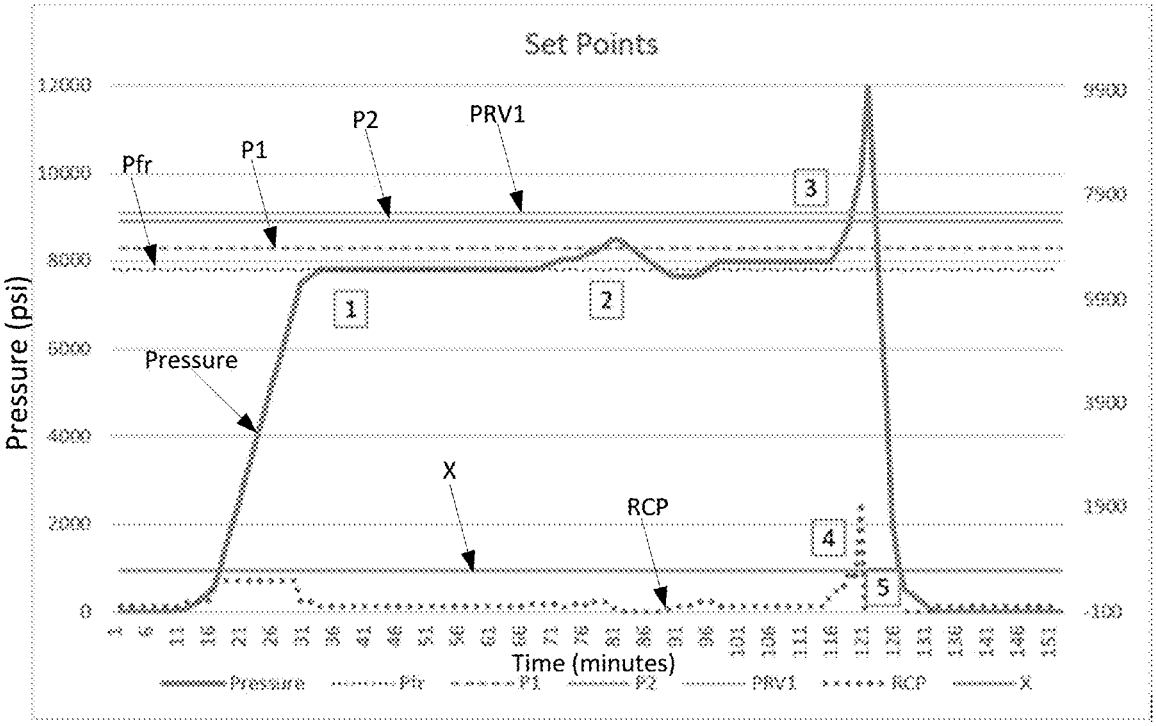
FIG. 5 is a graphical illustration of an operational high rate safety shutdown system according to an embodiment of the invention.

FIG. 5 is a graphical illustration of a control system process 200 according to one exemplary embodiment. Here, the anticipated treating pressure [Pfr] is set to 8000 psi, the maximum treating pressure [P1] is set to about 8200 psi, maximum equipment pressure [P2] is set to about 8850 psi, and the maximum equipment pressure as controlled via the PRV [PRV1] is set to about 9050 psi. The maximum rate of change of pressure is set at 1000 psi. At set point 1, the discharge pressure equals the anticipated discharge pressure. At set point 2, the discharge pressure is momentarily greater than the maximum treating pressure, so the system adjusts the treating pressure (e.g., by adjusting the position of the swashplate). At set point 3, the discharge pressure spikes such that the discharge pressure is significantly greater than the maximum equipment pressure. Substantially simultaneously, the rate of change or pressure at set point 4 is greater than the acceptable rate of change of pressure. Thus, a conduit may be plugged, or the formation may be plugged. Accordingly, the system performs an automatic shutdown, wherein the engine is depowered and the swashplate is set to a neutral position, and at set point 5, the discharge pressure is effectively zero, indicating successful shutdown.

By changing the angle of the swashplate to a neutral position, the fluid end of the pump can be nearly instantaneously stopped. As is understood by those of skill in the art, movement of the swashplate directly correlates to movement of the hydraulic piston(s) which drives the fluid end pistons. Thus, by controlling the angle of the swashplate, the fluid end pistons can be controlled to very fine degrees, and the control system which manages the position of the swashplate can manage the pressure within the system to very exact levels eliminating the dependency on mechanical pressure relief valves as the primary safety system. More specifically, the mass of the reciprocating assembly within the fluid end and the hydraulic drive cylinder are the only mechanisms that must be stopped. There is no connected mass associated with the rotational transmissions to decouple or stop, as is required in prior art systems. Additionally, there is no connected mass associated with the power ends with both rotational and reciprocating mass to be stopped. Therefore, the control system is significantly simplified and allows for quicker, more reliable control, and more importantly stopping of the hydraulic fracturing system.

The hydraulic pressure control system is utilized as the primary shut down and safety regulator when well pressures or system pressures and rate exceed design parameters. However, pressure relief valves may additionally be utilized as a secondary safety mechanism in the event that the primary safety mechanism fails, or the pressures within the hydraulic fracturing system are so extreme that the primary safety mechanism is inadequate to quickly and safely reduce the pressures within the system.

The hydraulic systems disclosed herein, specifically hydraulic control systems, hydraulic drive systems, the swashplates, hydraulic piping, and hydraulic cylinders are generally closed, and environmentally isolated from solids, dirt and contamination. This is significantly different from the pressure relief valves used for safety in the high-pressure conduit systems that are continuously exposed to fracturing fluids that are dirty, erosive, corrosive, and being pumped at very high pressures and rates. Thus, the control system may have repeatable performance over many thousands of cycles, which may significantly increase the reliability and life of the new safety systems, and the pumps being operated. Furthermore, by avoiding contact with dirty fluids, the hydraulic control systems require less maintenance than previous systems. Moreover, the high pressure hydraulic energy in the system can be released or bypassed instantaneously into closed loop recirculation systems without any release to the atmosphere. This allows the system to depressurize without the release of well fluids, which may be harmful to the environment.

Importantly, the couplings between the systems are fluid in nature; there are no mechanical couplings between the power sources and the fluid end hydraulic drive. Furthermore, the need for transmissions is eliminated, so the large rotational movements associated with transmissions are eliminated. In the hydraulic system, the rotational moments contained in the gear box and hydraulic pumps are isolated from the fluid ends by the fluid connections. Finally, there is significantly less mass in motion during pumping and pressurization of the fracturing fluids in the case of a hydraulic system as compared to prior art systems.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

The invention claimed is:

1. A high rate safety shutdown system, comprising:

an engine;

a gearbox, a hydraulic pump having a swashplate and a hydraulically driven reciprocating cylinder operable to drive a reciprocating piston in a fluid end of the pump;

a pressure sensor;

a pressure relief valve; and a control system operable to control the swashplate of the hydraulic pump and the engine, the control system comprising a processor in data communication with at least one input/output device, and computer memory, the computer memory comprising a program having machine readable instructions that, when effected by the processor, perform the following steps:

(a) receive set threshold values from the input/output device for maximum treating pressure, maximum allowable equipment pressure, maximum rate of change of pressure, pressure relief valve setting, and flow rate;

(b) determine a first position of the swashplate as a function of the flow rate;

(c) activate the engine to provide power to the hydraulic pump;

(d) determine a first discharge pressure of the system via the pressure sensor;

(e) determine a rate of change of pressure via the pressure sensor;

determine if:

(f1) the first discharge pressure is greater than the pressure relief valve setting;

(f2) the first discharge pressure is greater than the maximum allowable equipment pressure; and (f3) the rate of change of pressure is greater than the maximum rate of change of pressure;

(g) determine if:

(g1) the first discharge pressure is less than the maximum allowable equipment pressure but greater than the maximum treating pressure; and (g2) the rate of change of pressure is less than the maximum rate of change of pressure;

(h) trigger the pressure relief valve and determine a second position of the swashplate upon the occurrence of (f1), (f2), or (f3); and (i) determine a third position of the swashplate upon the occurrence of (g1) and (g2).

2. The safety shutdown system of claim 1, wherein, upon the occurrence of (f1), (f2), or (f3), the instructions further perform the following step:

(j) de-power the engine.

3. The safety shutdown system of claim 2, wherein the second position of the swashplate is neutral.

4. The safety shutdown system of claim 3, wherein the instructions further perform the following steps:

(k) determine a second discharge pressure via the pressure sensor;

(l) determine if the second discharge pressure is below the maximum treating pressure;

(m) if the second discharge pressure is below the maximum treating pressure, set the swashplate to the first position; and (n) repeat steps (b)-(i).

5. The safety shutdown system of claim 1, wherein the triggering of the pressure relief valve at step (h) causes an unanticipated change in the first discharge pressure, and wherein the instructions further perform the following step:

(j) de-power the engine to eliminate power in response to the unanticipated change in the first discharge pressure.

6. The safety shutdown system of claim 5, wherein the second position of the swashplate is neutral.

7. The safety shutdown system of claim 6, wherein the instructions further perform the following step:

(k) verify, via an input, a safe operational condition of the system prior to repowering the system.

8. The safety shutdown system of claim 1, wherein the instructions further perform the following step:

(j) upon the non-occurrence of steps (f1), (f2), (f3), (g1), and (g2), repeating steps (b)-(j).

9. The safety shutdown system of claim 1, wherein the pressure sensor comprises a plurality of pressure sensors.

10. The safety shutdown system of claim 1, wherein the control system further comprises a networking device, and wherein the input/output device is a mobile device in operable communication with the control system over a network.

11. The safety shutdown system of claim 1, wherein the hydraulic pump is hydraulically driven via hydraulic fluids.

12. A high rate safety shutdown system, comprising:

an engine;

a gearbox;

a hydraulic pump having a swashplate and a hydraulically driven reciprocating cylinder operable to drive a reciprocating piston in a fluid end of the pump;

a pressure sensor; and a control system operable to control the swashplate of the hydraulic pump and the engine, the control system comprising a processor in data communication with at least one input/output device, and computer memory, the computer memory comprising a program having machine readable instructions that, when effected by the processor, iteratively perform the following steps:

(a) receiving set threshold values from the input/output device for maximum treating pressure, maximum allowable equipment pressure, maximum rate of change of pressure, pressure relief valve setting, and flow rate;

(b) determining a first position of the swashplate as a function of the flow rate;

(c) activating the engine to provide power to the hydraulic pump;

(d) determining a first discharge pressure of the system via the pressure sensor;

(e) determining if:

(e1) the first discharge pressure is greater than the pressure relief valve setting;

(e2) the first discharge pressure is greater than the maximum allowable equipment pressure; and (e3) the rate of change of pressure is greater than the maximum rate of change of pressure; and (f) upon the occurrence of (e1), (e2) or (e3), setting the swashplate to a neutral position, activating the pressure relief valve, and reducing the power to the engine.

13. The safety shutdown system of claim 12, wherein reducing the power to the engine at step (f) comprises de-powering the engine.

14. The safety shutdown system of claim 12, further comprising the steps of:

(g) verifying, via an input, a safe operational condition of the system prior to repowering the system;

(h) resetting the pressure relief valve;

(i) activating the engine to produce the flowrate; and (j) repeating steps (b)-(i).

15. The system of claim 14, further comprising the steps of:

(k) upon the non-occurrence of step (g), maintaining the swashplate at the neutral position and the reduced power to the engine.

16. The safety shutdown system of claim 12, wherein the pressure sensor is a plurality of pressure sensors.

17. The safety shutdown system of claim 12, wherein the control system further comprises a networking device, and wherein the input/output device is a mobile device configured to communicate with the control system over a network.

18. The safety shutdown system of claim 12, wherein the hydraulic pump is hydraulically driven via hydraulic fluids.

19. The safety shutdown system of claim 12, further comprising a second sensor in communication with the control system, wherein the second sensor is selected from the list consisting of: a temperature sensor, a level sensor, a flow rate meter, and a particulate matter sensor.

20. A method of controlling a high-pressure system comprising an engine, and a hydraulic pump having a swashplate and a hydraulically driven reciprocating cylinder operable to drive a reciprocating piston in a fluid end of the pump, the method comprising:

(1) inputting a maximum discharge pressure, a maximum allowable equipment pressure, a pressure relief valve setting, a flowrate, a maximum positive rate of change of pressure, and a maximum negative rate of change of pressure;

(2) setting a work value of the high-pressure system to required power to the engine;

(3) setting a first position of the swashplate as a function of flowrate;

(4) determining:

(a) if a discharge pressure is greater than the pressure relief valve setting;

(b) if the discharge pressure is greater than the maximum allowable equipment pressure;

(c) if a rate of change of pressure is greater than the maximum positive rate of change of pressure; and (d) if the rate of change of pressure is greater than the maximum negative rate of change of pressure;

(5) upon the occurrence of any of steps 4(a)-4(d):

(e) activating a pressure relief valve in the system;

(f) setting the swashplate position to neutral; and (g) reducing the engine power to zero.

* * * * *